United States Patent [19]

Howard et al.

[11] Patent Number: 4,591,281

[45] Date of Patent: May 27, 1986

[54] SHEET-FEED MECHANISM FOR ROTARY PRINT HEAD

[75] Inventors: Robert Howard, New York, N.Y.; Richard R. Helinski, Hudson, N.H.; John R. Larsen, Hampstead, N.H.; Herbert E. Menhennett, Windham, N.H.

[73] Assignee: Howtek, Inc., Hudson, N.H.

[21] Appl. No.: 669,671

[22] Filed: Nov. 8, 1984

[51] Int. Cl.[4] ..... B41J 3/02

[52] U.S. Cl. ..... 400/126; 346/75

[58] Field of Search ..... 400/126, 112–115, 400/623–625, 637, 642; 346/75

[56] References Cited

U.S. PATENT DOCUMENTS 3,864,696 2/1975 Fischbeck ..... 400/126 X 3,925,790 12/1975 Fischbeck ..... 400/126

OTHER PUBLICATIONS

"Centrifugal Ink Jet Printer", IBM Tech. Discl. Bulletin, vol. 21, No. 11, Apr. 1979, pp. 4668–4669.

"Ink Jet Printing on Paper Moving Inside a Stationary Cylinder", IBM Tech. Discl. Bulletin, vol. 21, No. 11, Apr. 1979, pp. 4406–4407.

*Primary Examiner*—E. H. Eickholt

*Attorney, Agent, or Firm*—Cesari and McKenna

[57] ABSTRACT

A sheet-feed mechanism (10) for a rotary print head (12) includes a track (16) that defines a paper path in the form of a partial circular annulus. Belts (40 and 42) carry tabs (36, 38, 72, and 74) that support the lower end of a paper sheet, and movement of the belt causes the tabs to raise the paper sheet as it is printed. A guide structure (60) keeps the paper sheet in the proper cylindrical shape until it has left the track, at which time a curved portion (67) of a cam post (66) urges the paper out so that it pops open to a flat shape and falls into a tray (70).

23 Claims, 3 Drawing Figures

SHEET-FEED MECHANISM FOR ROTARY PRINT HEAD

BACKGROUND OF THE INVENTION

The present invention pertains to sheet-feed mechanisms. It is particularly directed to a sheet-feed mechanism for feeding paper to a rotary print head.

As the speeds of printers have increased, it has been found that one of the principal speed limitations is inertia; the force required to start and stop the print carriage is considerable, and the starting and stopping often shakes the table or other object on which the printer is supported. A related problem, and the one with which the present invention is concerned, is that of feeding the paper rapidly and accurately. The feed mechanism must accurately and repeatably position paper sheets both angularly and axially.

SUMMARY OF THE INVENTION

A sheet-feed mechanism meeting these requirements includes a paper track that is disposed adjacent the print head and that defines a paper path in the shape of a partial circular annulus that is coaxial with the rotational axis of the rotary print head. The paper track has an entrance into the paper path through which paper is fed laterally. The paper track also has an exit opening through which paper sheets leave the track axially. A feeder mechanism for advancing the paper along the paper path includes a movable feeder tab that engages the trailing edge of the paper sheet located in the paper path and urges it past the print head.

Preferably, the feed mechanism is oriented vertically, and a cam structure is provided at the exit opening so that, when the sheet has been fed most of the way out of the paper track, its upper end is engaged by a cam surface that urges the paper in the direction generally faced by the printed surface. As a result, the paper falls in this direction when it has been lifted completely past the print head, and it is received in a receptacle provided at one side of the paper track.

Another aspect of the invention involves the mechanism for loading the paper sheets laterally into the paper track before they are fed vertically past the print head. This loading mechanism includes a drive roller that has a gripping surface and is operable to rotate about a drive axis. It is so oriented that its gripping surface crosses the tangent to the paper path at the entrance opening. An idler roller forms a nip with the drive roller, the nip being displaced from the tangent to the paper path at the opening so that a paper sheet extending partially into the paper track is biased against the gripping surface of the drive roller. As a result, the trailing edge of a paper sheet is driven by the drive roller, even after it leaves the nip, until it reaches the tangent to the paper track. This results in a very repeatable angular alignment of the paper sheet.

BRIEF DESCRIPTION OF THE DRAWINGS

These and further features and advantages of the present invention are described in greater detail in connection with the accompanying drawings, in which.

DETAILED DESCRIPTION OF THE PREFERRED EMBODIMENT

Figure 1:
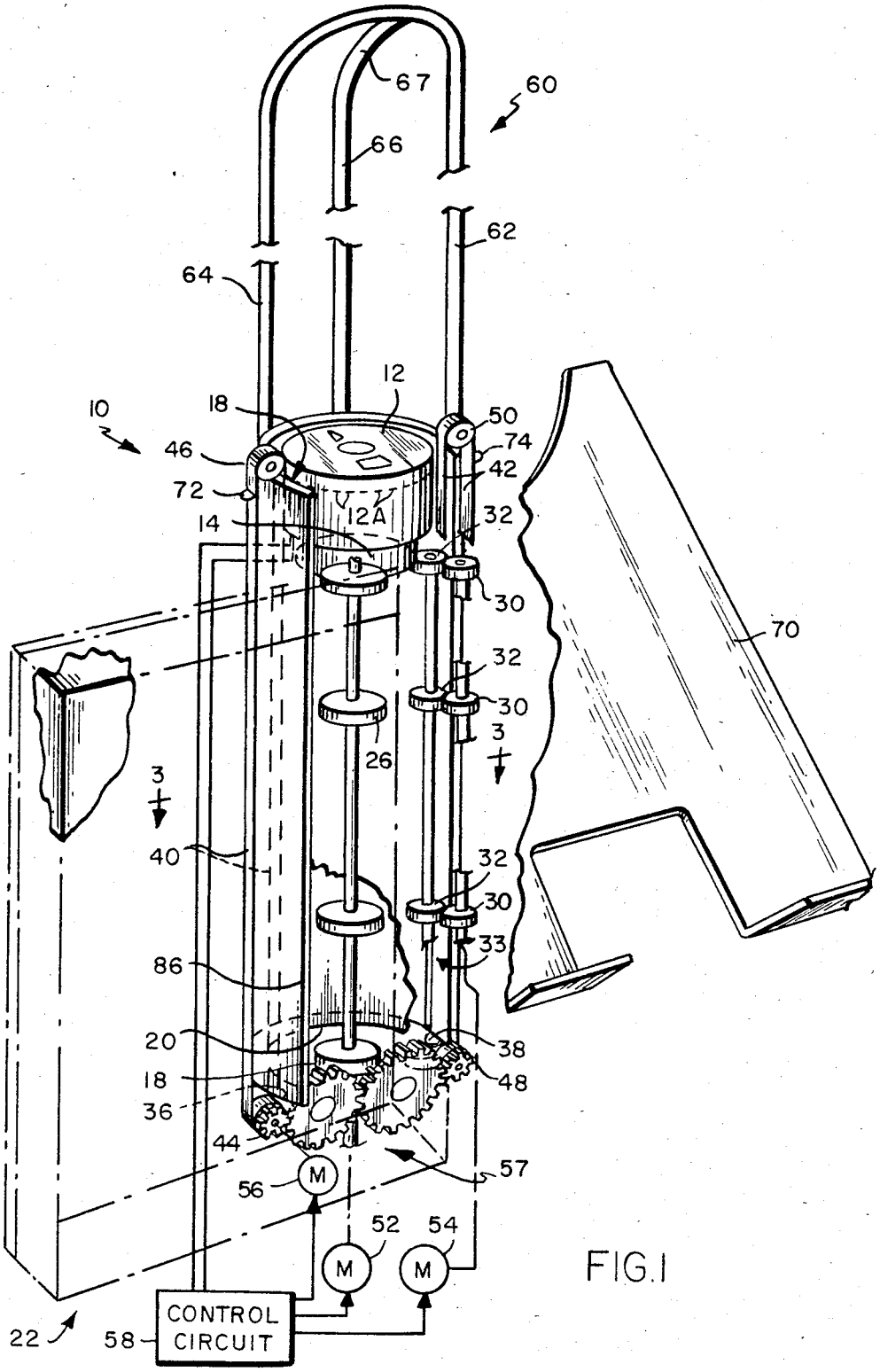
FIG. 1 is a simplified vertical perspective view, partially diagrammatic, of the sheet-feed mechanism of the present invention shown with the sheet being fed laterally into the sheet track.

In FIG. 1, a cassette 22 containing a stack of sheets to be imprinted supplies the sheets one at a time to a vertically oriented sheet feeder 10. Then the feeder 10 advances the sheets vertically past a rotary print head 12, which imprints the desired information on them in response to signals from a print-head driver (not shown). For purposes of illustration, the print head 12 in the illustrated embodiment is shown as an ink-jet print head that emits droplets of ink through nozzles **12*a*** provided on its periphery for forming an image on a sheet. It will be understood that the sheet-feed mechanism of the present invention can be employed with other rotary-type print heads as well.

To give the proper shape to the paper sheet, a track 16 is provided. The track 16 includes an outer sleeve 18 having an inner surface **18*a* (FIG. 3) in the shape of a partial cylinder. The track also includes an inner sleeve 20 whose outer surface 20*a* (FIG. 3) is in the shape of a partial cylinder coaxial with the inner surface 18*a* of the outer sleeve 18. Thus, the surfaces 18*a* and 20*a*** together define a paper path in the shape of a partial circular annulus.

Figure 3:
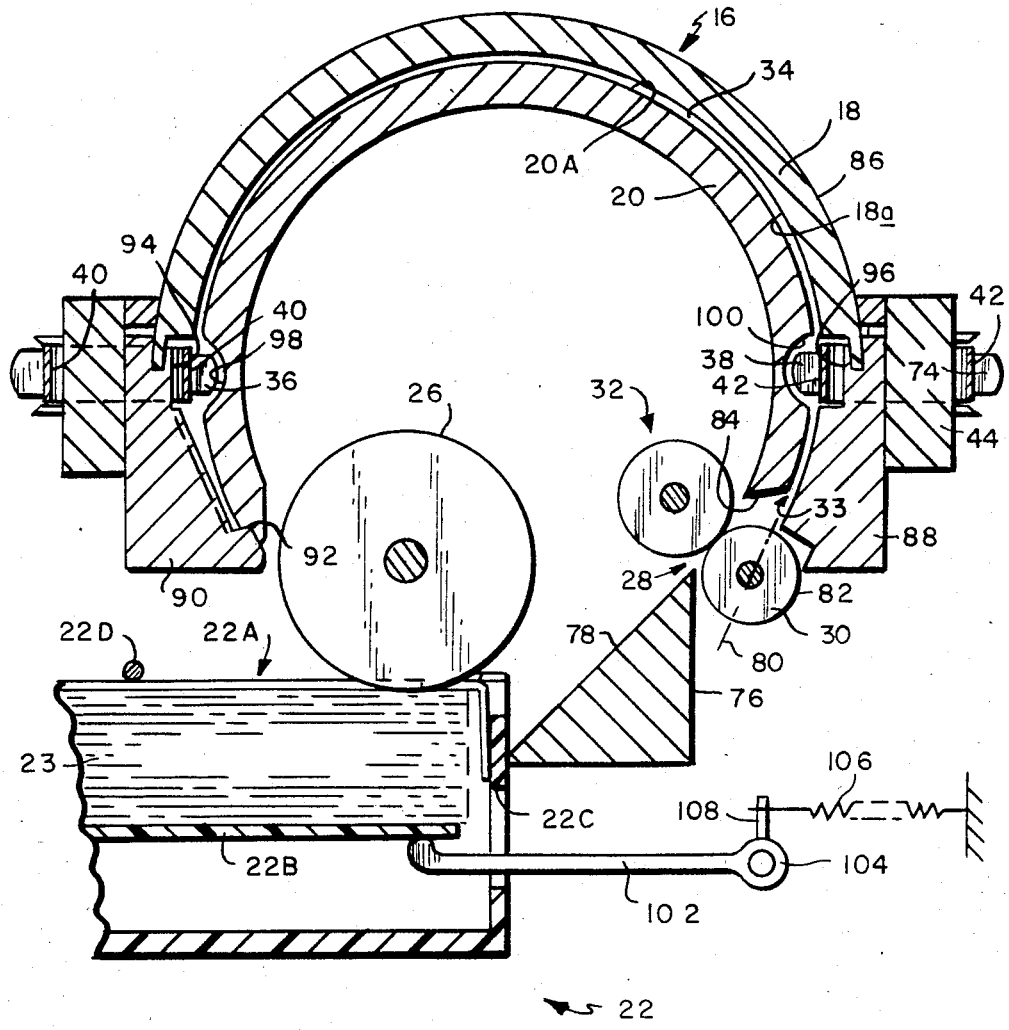
FIG. 3 is a more-detailed horizontal cross-sectional view of the feed mechanism taken along the lines 3—3 of FIG. 1.

Paper is fed into the track 16 from a paper cassette 22. As FIG. 3 illustrates, the cassette 22 comprises a rectangular chamber having an open face **22*a* through which sheets of paper to be imprinted are fed one at a time. The cassette 22 differs from conventional cassettes in that it is arranged to operate properly in a vertical orientation, whereas conventional cassettes are oriented horizontally in operation. Specifically, conventional paper cassettes are spring-loaded to urge the paper against a feed roller, and the relationship of spring force to displacement is ordinarily arranged to accommodate the change in the weight of the paper stack as the stack size decreases. In cassette 22, on the other hand, the plate 22*b* on which the paper sheets 23 rest applies a force that is independent of stack size. A fork 102 extends through an opening 22*c* in the cassette wall and is rigidly attached to a pivot shaft 104 pivotally mounted on a support not shown in the drawings. It is biased by an expansion spring 106 that applies torque by way of a lever arm 108 rigidly secured to the pivot shaft 104. The force of the spring 106** is nearly constant throughout the normal print range of the fork so that the force with which sheets are urged against the feed roller is independent of stack size.

Cassette 22 also differs from conventional cassettes in that it includes a restraining member bar **22*d* over the opening 22*a*** so that the paper does not fall out.

To load the track 16, pick-up rollers 26 drive the top paper sheet in the cassette 22 into the nips 28 (FIG. 3) formed between feed rollers 30 and idler rollers 32. These rollers are mounted adjacent a lateral entrance 33, and the rollers feed the top sheet into the annulus 34 between the inner and outer sleeves 18 and 20.

The sheet fed into the track assumes the shape of a partial cylinder so that the entire sheet surface to be imprinted is equidistant from the axis of the spinning rotary print head. The print head scans across the sheet line by line, laying down a series of dots on successive lines to form the desired character or other information. In contrast to conventional linear printers, which stop and reverse direction on each line, the print head here undergoes continuous circular scanning, and the sheet is preferably also continuously advanced vertically along the track 16.

Drive and idler pulleys 44 and 46 (FIG. 1) are mounted adjacent to the outer sleeve 18 and train a belt 40 in a loop that extends through the paper path. The belt 40 carries a feeder tab 36 located in the paper path to support the lower edge of the paper sheet. Similarly, drive and idler pulleys 48 and 50 train a belt 42 with a tab 38 through the paper path to support the lower edge of the sheet. Motors 52, 54, and 56 and control circuitry 58 control the axial advance of the sheet. Motor 52 drives the pick-up rollers 26, motor 54 drives the feed roller 30, and motor 56 drives pulley 44 directly and drives pulley 48 through a gear train 57. The control circuitry 58 controls all of these motors as well as the print head 12 and print-head motor 14.

We prefer to provide motor 56 as a stepper motor. Although the vertical motion of the sheet is ordinarily constant, it is sometimes desirable to provide some speed variation, for instance, to reduce the time taken up by large spaces in the text, such as upper and lower margins.

Figure 2:
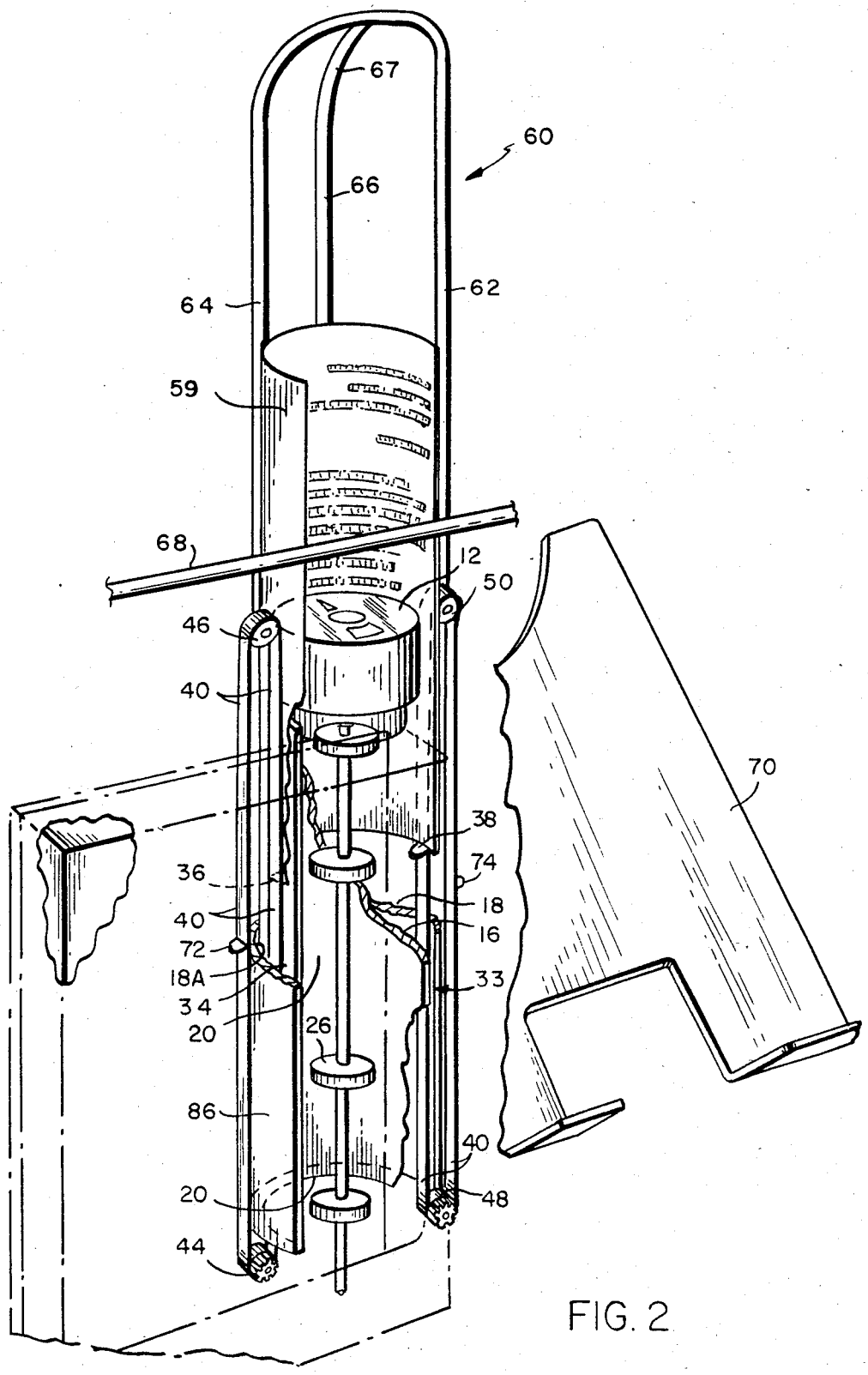
FIG. 2 is a similar view with parts removed, showing the sheet after it has been fed vertically part of the way out of the sheet track.

FIG. 2 depicts a paper sheet 59 after it has been raised about halfway out of the track 16. To maintain the generally cylindrical shape of the paper as it leaves the track, a guide structure 60 extends above the track. This guide structure includes a pair of guide posts 62 and 64 extending generally parallel to the axis of the rotary print head and providing confining surfaces to bear against the outer face of the sheet 59. A cam post 66, which is straight along most of its length, also aids in maintaining the cylindrical shape of the sheet 59 as it leaves the track 16. When the sheet has nearly reached the top of the track, however, a curved cam portion 67 of the cam post 66 urges the upper end of the sheet outward. The effect is that, when the sheet has left the track 16 completely, the cam portion 67 urges the sheet outward enough that it "pops" out of its cylindrical shape into a flat shape and falls forward.

As the sheet falls forward, its lower portion hits a horizontal barrier post 68, which momentarily restrains the lower portion of the paper while the upper end tips forward, causing it to fall first into a tray 70 provided to receive the printed sheets.

When the sheet has left the track, another sheet is fed into the track. Second tabs 72 and 74, which are shown in FIG. 2 as being carried on the portions of the belts 40 and 42 outside the track, arrive at the lower end of the paper path and carry this sheet upward.

The manner in which a sheet is loaded into the track can be appreciated best by reference to FIG. 3, which is a simplified cross-sectional view of the track showing the geometric relationships among the various rollers and the track. FIG. 3 shows the cassette 22 containing the paper stack 23 that is engaged by the pick-up roller 26 so that the top sheet is fed toward the entrance 33 to the track. A pick-up guide member 76 at the outlet of the cassette has a surface 78 that guides the paper sheet into the nip 28 between the feed roller 30 and the idler roller 32.

The nip 28 is laterally offset from the tangent 80 to the paper path. This tangent extends through the frictional (typically soft-rubber) surface 82 of feed roller 30 and is perpendicular to it. Accordingly, a paper sheet leaving the nip is not initially aligned with the entrance portion of the paper path defined by the track 16. A curved entrance guide 84, provided as an extension of the inner sleeve 20, bends the paper to guide it into the lateral opening 33 so that the paper is bent more than it otherwise would be in reaching the annular paper path 34. This extra curvature biases the paper against the frictional surface 82 of the feed roller 30 so that this surface continues to drive the trailing edge of the paper even after it has left the nip 28 until the sheet is aligned with the tangent 80 to the track 16 at the opening 33. This insures that the sheet is positioned with its trailing edge just touching surface 82 along the track tangent 80 when the sheet is picked up by tabs 94 and 96 and insures an accurate, repeatable angular positioning of the paper sheet within the track.

As FIG. 3 shows, the sleeve 18 is made of three parts, a semi-cylindrical portion 86 and two end blocks 88 and 90. A stop surface 92 on block 90 defines the lateral end of the paper path opposite the entrance opening 33. When the sheet has been fed angularly into the paper track, its leading edge ordinarily does not quite hit the stop surface 92 of the end block 90, because the angular extent of the paper path is great enough to accommodate normal tolerances in the widths of the paper sheets. However, the stop insures that sheets within these tolerances nonetheless remain properly aligned during vertical feeding.

Also apparent in FIG. 3 is the manner in which the drive belts 40 and 42 are fed through the track. Specifically, the outer sleeve 18 has a pair of axially extending recesses 94 and 96 so as to provide belt tracks for drive belts 40 and 42. The inner sleeve 20 has axially extending recesses 98 and 100 oriented in opposition to recesses 94 and 96 to accommodate the tabs 36 and 38.

In view of the foregoing description, it can be appreciated that the paper feed of the present invention provides a simple and elegant paper drive for a rotary printer. Its vertical orientation permits the printer to assume a vertical orientation, which is the preferred orientation for proper ink feed. Additionally, it maintains the proper shape of the paper sheet being printed until the printing has been complete, and it then "pops" the paper out in a simple manner to allow it to be stacked flat. Furthermore, the orientation of the drive rollers, the paper path, and the guide surface insure accurate angular positioning of the sheet in the paper path.

We claim:

1. A sheet-feed mechanism for feeding paper past a rotary print head, the sheet-feed mechanism comprising:

A. a paper track disposed adjacent the print head and defining a paper path, in the shape of a partial circular annulus coaxial with the rotational axis of the rotary print head, along which paper located in the track can be moved axially past the print head for printing, the paper track having an axially extending lateral opening through which paper can be fed laterally into the paper path before being moved axially along it, the paper track also having an exit opening at one end of the paper track through which paper sheets leave the paper track axially; and B. a feeder mechanism including a movable feeder tab, the feeder mechanism being operable to position the feeder tab in the paper path and move it axially along the paper path for moving a sheet therewith.

2. A sheet-feed mechanism as defined in claim 1 wherein the feeder mechanism includes:

A. a feeder belt seated in the belt track and carrying the feeder tab; and

B. belt-drive means for driving the belt axially along the belt track.

3. A sheet-feed mechanism as defined in claim 2 wherein:

A. the track includes an inner and outer sleeves having complementary surfaces that define the partial circular annulus, one of the sleeves having an axially extending tab recess therein; and B. the feeder tab extends into the tab recess when it is in the paper path.

4. A sheet-feed mechanism as defined in claim 2 wherein

A. the feeder mechanism further includes a second feeder belt carrying a second-belt feeder tab; and B. the belt-drive means drives the second belt to position the second-belt feeder tab in the paper path and advance it axially, in lateral alignment with a tab carried by the first-mentioned belt, along the paper path for moving a sheet therewith in cooperation with the first belt.

5. A sheet-feed mechanism as defined in claim 4 wherein:

A. each belt is an endless belt that extends along the paper path and loops back along a return path outside the paper path; and B. each belt carries a second feeder tab spaced along the belt from the first-mentioned feeder tab carried thereby so that, as one of the feeder tabs on a given belt is disposed in the paper path, the other is disposed in the return path.

6. A sheet-feed mechanism as defined in claim 2 wherein:

A. the belt is an endless belt that extends along the paper path and loops back along a return path outside the paper path; and B. the belt carries a second feeder tab spaced along the belt from the first-mentioned feeder tab carried thereby so that, as one of the feeder tabs is disposed in the paper path, the other is disposed in the return path.

7. A sheet-feed mechanism as defined in claim 2 wherein:

A. the track includes inner and outer sleeves having complementary surfaces that define the partial circular annulus, one of the sleeves having an axially extending belt recess therein to provide a belt track; and B. the belt drive means drives the belt along the belt track.

8. A sheet-feed mechanism as defined in claim 7 wherein:

A. one of the sleeves has an axially extending tab recess therein; and

B. the feeder tab extends into the tab recess when it is in the paper path.

9. A sheet-feed mechanism as defined in claim 7 wherein:

A. the belt is an endless belt that extends along the paper path and loops back along a return path outside the paper path; and B. the belt carries a second feeder tab spaced along the belt from the first-mentioned feeder tab carried thereby so that, as one of the feeder tabs is disposed in the paper path, the other is disposed in the return path.

10. A sheet-feed mechanism as defined in claim 7 wherein

A. one of the sleeves has a second axially extending recess therein to provide a second belt track angularly spaced from the first-mentioned belt track;

B. the feeder mechanism further includes a second feeder belt seated in the second belt track and carrying a second-belt feeder tab; and C. the belt-drive means drives the second belt axially along the second belt track to position the second-belt feeder tab in the paper path and move it axially, in horizontal alignment with a feeder tab carried by the first-mentioned belt, along the paper path for moving a sheet therewith in cooperation with the first belt.

11. A sheet-feed mechanism as defined in claim 10 wherein:

A. each belt is an endless belt that extends along the paper path and loops back along a return path outside the paper path; and B. each belt carries a second feeder tab spaced along the belt from the first-mentioned feeder tab carried thereby so that, as one of the feeder tabs is disposed in the paper path, the other is disposed in the return path.

12. A sheet-feed mechanism as defined in claim 1 wherein the axis of the rotary print head is vertical and the feeder mechanism advances the feeder tab upward past the print head.

13. A sheet-feed mechanism as defined in claim 12 further including:

A. a sheet receptacle located to the side of the paper track generally faced by the inner side of a sheet in the paper path; and B. a cam structure having a cam surface disposed above the print head and located to engage the upper edge of the sheet and urge it in the direction generally faced by its inner side so that the sheet falls into the receptacle when the feeder mechanism lifts the sheet free of the guide.

14. A sheet-feed mechanism as defined in claim 13 further including an upper guide structure disposed above the paper track and providing upper guide surfaces that engage the outer face of a sheet leaving the paper guide to prevent the sheet from opening before the cam surface urges it toward the receptacle.

15. A sheet-feed mechanism as defined in claim 14 wherein:

A. the receptacle comprises a tray inclined away from the paper guide; and

B. the sheet-feed mechanism further includes a barrier structure located in the path taken by a paper sheet in reaching the receptacle to block the lower part of the sheet and thereby cause the upper part of the sheet to tip over and enter the receptacle first.

16. A sheet-feed mechanism as defined in claim 13 wherein:

A. the receptacle comprises a tray inclined away from the paper guide; and

B. the sheet-feed mechanism further includes a barrier structure located in the path taken by a paper sheet in reaching the receptacle to block the lower part of the sheet and thereby cause the upper part of the sheet to tip over and enter the receptacle first.

17. A sheet-feed mechanism as defined in claim 1 further including a loading mechanism that includes:

A. a drive roller having a gripping surface and operable to rotate about a drive axis, its gripping surface crossing the tangent to the paper path at the entrance opening; and B. an idler roller for rotating about an idler axis and forming with the drive roller a nip displaced from the tangent to the paper path at the entrance opening so that a paper sheet extending partially into the paper track is biased against the drive roller, the trailing edge of a paper sheet thereby being driven by the drive roller, even after it leaves the nip, until it reaches the tangent to the paper path.

18. A sheet-feed mechanism as defined in claim 17 wherein the loading mechanism further includes a pick-up roller oriented with its axis parallel to those of the drive and idler rollers, adapted to placing of a stack of paper sheets against it, and operable by rotation thereof to drive the top sheet of the stack placed against it into the nip between the drive and idler rollers.

19. A sheet-feed mechanism comprising:

A. a paper track providing opposed inner and outer walls that define a paper path in the shape of a partial circular annulus along which paper can be advanced axially, the guide providing a lateral entrance opening into the track through which paper can be fed angularly before being advanced axially; and B. a loading mechanism for feeding a paper sheet angularly into the paper track, the loading mechanism including:

(1) a drive roller having a gripping surface and operable to rotate about a drive axis, its gripping surface crossing the tangent to the paper path at the entrance opening; and (2) an idler roller for rotating about an idler axis and forming with the drive roller a nip spaced from the tangent to the paper path at the opening so that a paper sheet extending partially into the paper track is biased against the drive roller, the trailing edge of a paper sheet thereby being driven by the drive roller, even after it leaves the nip, until it reaches the tangent to the paper track.

20. A sheet-feed mechanism as defined in claim 19 wherein the loading mechanism further includes a pick-up roller oriented with its axis parallel to those of the drive and idler rollers, adapted to placing of a stack of paper sheets against it, and operable by rotation thereof to drive the top sheet of the stack placed against it into the nip between the drive and idler rollers.

21. A sheet-feed mechanism as defined in claim 20 further including an entrance guide member having an entrance guide surface for directing into the entrance opening the leading edge of a paper sheet emerging from the nip.

22. A sheet-feed mechanism as defined in claim 21 further comprising a second guide member having a second guide surface for directing into the nip the leading edge of sheet driven by the pick-up roller.

23. A sheet-feed mechanism as defined in claim 19 further including an entrance guide member having an entrance guide surface for directing into the entrance opening the leading edge of a paper sheet emerging from the nip.

* * * * *